US006059308A

United States Patent [19]

Baudin et al.

[11] Patent Number: 6,059,308

[45] Date of Patent: May 9, 2000

[54] GLIDING BOARD SURROUNDED WITH A CONTINUOUS RUNNING EDGE, AND METHOD OF MAKING SAME

[75] Inventors: Jerome Baudin, Alby Sur Cheran; Eric Metrot, Saint-Jorioz; Robert Perrier, Seyssel; Jean-Noel Thevenoud, Rumilly, all of France

[73] Assignee: Salomon S.A., Metz-Tessy, France

[21] Appl. No.: 08/824,120

[22] Filed: Mar. 26, 1997

[30] Foreign Application Priority Data

Mar. 27, 1996 [FR] France ..... 96 04035

[51] Int. Cl.[7] ..... A63C 5/048; A63C 5/03

[52] U.S. Cl. ..... 280/610; 280/608; 280/14.2

[58] Field of Search ..... 280/608, 609, 280/610, 14.2; 156/228; 228/212

[56] References Cited

U.S. PATENT DOCUMENTS

| | | | |
|---|---|---|---|
| 3,259,969 | 7/1966 | Tessmann | 228/212 |
| 3,416,810 | 12/1968 | Kennedy, III | 280/610 |
| 3,635,482 | 1/1972 | Holman | 280/610 |
| 3,915,368 | 10/1975 | Ulmer | 228/212 |
| 4,270,768 | 6/1981 | Nakanishi | 280/610 |
| 4,778,710 | 10/1988 | Deutsch | 280/608 |
| 4,810,001 | 3/1989 | Fischer | 280/608 |
| 5,057,170 | 10/1991 | Legrand et al. | 280/610 |
| 5,288,097 | 2/1994 | Pascal et al. | 280/610 |
| 5,294,139 | 3/1994 | Cazaillon et al. | 280/610 |
| 5,320,378 | 6/1994 | Wiig | 280/610 |
| 5,372,370 | 12/1994 | Rohrmoser | 280/610 |
| 5,449,425 | 9/1995 | Renard et al. | 156/78 |
| 5,549,776 | 8/1996 | Juriga | 156/228 |
| 5,672,216 | 9/1997 | Robic | 228/212 |

FOREIGN PATENT DOCUMENTS

| | | | |
|---|---|---|---|
| 0581098 | 2/1994 | European Pat. Off. . | |
| 2334995 | 1/1975 | Germany | 280/608 |
| 8711227 | 11/1987 | Germany . | |

*Primary Examiner*—Kenneth R. Rice
*Assistant Examiner*—Frank Vanaman
*Attorney, Agent, or Firm*—Greenblum & Bernstein, P.L.C.

[57] ABSTRACT

Gliding board, especially a snowboard with a composite structure, constituted by a solid core about which are adhered, on the one hand, at least one upper mechanical resistance element, and on the other hand, at least one lower mechanical resistance element on which a gliding bottom surface surrounded with a peripheral metallic running edge is arranged, wherein the metallic running edge is constituted by at least one steel shaped element whose length is substantially equal to the periphery of the bottom surface, and whose free ends are affixed to one another at a butt connecting point via an effective mechanical linkage device, so as to obtain a running edge that closes over itself.

13 Claims, 2 Drawing Sheets

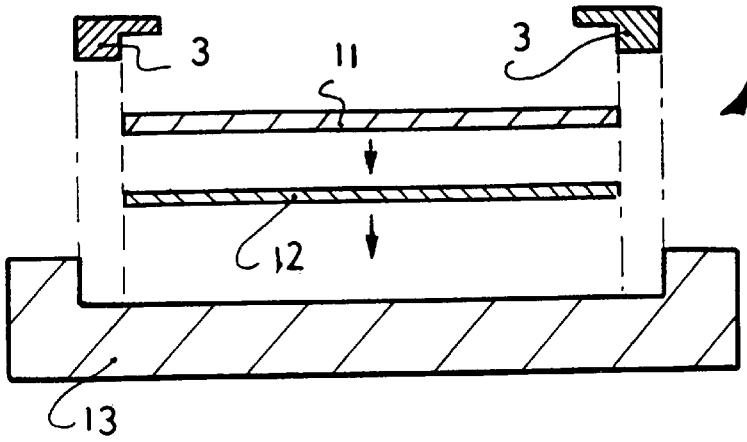
Fig:5
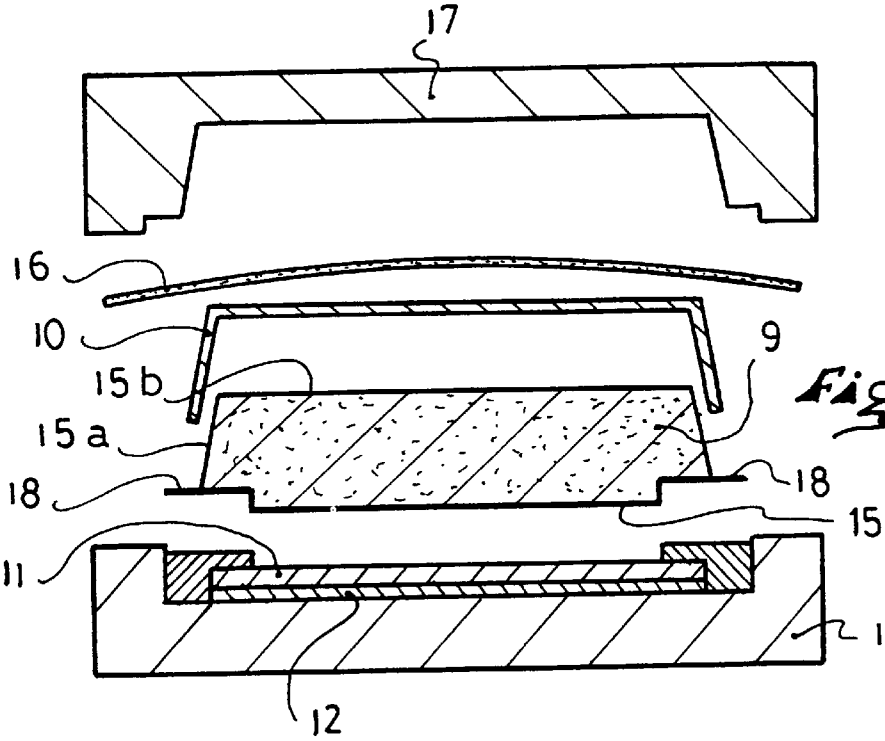
Fig:6
Fig:7
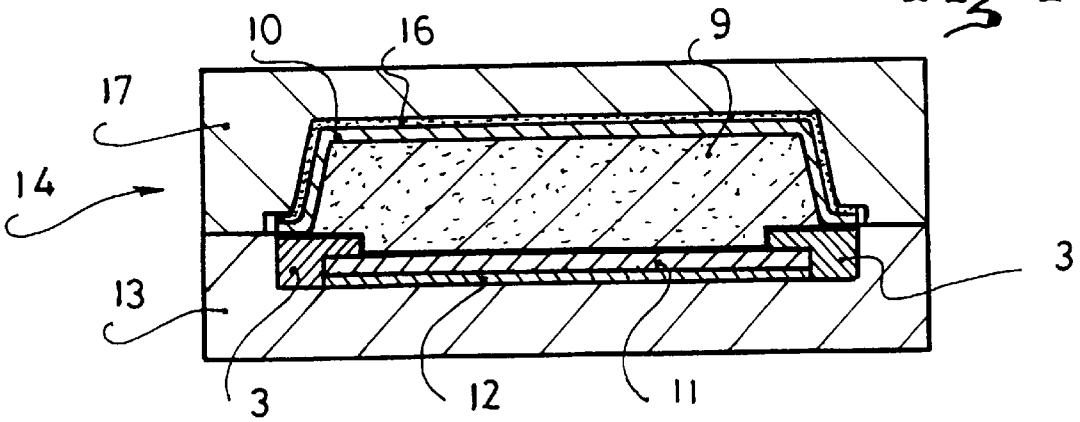

GLIDING BOARD SURROUNDED WITH A CONTINUOUS RUNNING EDGE, AND METHOD OF MAKING SAME

BACKGROUND OF THE INVENTION

1. Field of the Invention

The present invention relates to a gliding board, especially a snowboard, as well as its manufacturing process.

2. Background and Material Information

Currently available snowboards generally have a composite structure in which various materials are combined, such that each functions optimally, with regard to the distribution of the mechanical stresses. Thus, the structure generally includes decoration and peripheral protection elements, forming the top surface and the lateral surfaces of the snowbaord internal, resistance elements or load-carrying layers, which are made out of a material having a high mechanical strength and stiffness. The structure also includes filling elements such as a core with a honeycomb structure or made of wood, a gliding sole forming the bottom surface of the ski and ensuring proper gliding on the snow, and metallic running edges forming the bottom surface edges of the ski board or snowboard.

To obtain the appropriate physical characteristics, the manufacture of modern boards therefore calls for a wide variety of materials: the gliding bottom surfaces are generally made of polyethylene, the honeycomb cores are made of synthetic foam, and the running edges are made of steel, the top surfaces of the ski are made of a thermoplastic sheet, and the load-carrying layers are metal or fiber-reinforced resin plates.

In the particular field of snowboarding, the running edge is preferably constituted by a steel shaped element surrounding the bottom surface, including its turned-up portions at the rear, forming the tail, and at the front, forming the shovel, unlike an alpine ski or cross country on which the running edge is arranged solely on the lateral sides, because its primary role is to ensure the gripping of the ski to enable turning, stopping, etc. Conversely, snowboarding is a form of sport where all of the parts constituting the board, including the shovel and the tail, are used, in addition to its lateral sides, to make it possible accomplish ballet-type acrobatic movements, take support, land from jumps, etc.

Furthermore, in snowboarding, the running edge also plays a protective role, and it must therefore resist substantial mechanical stresses to prevent any fracture during the bending of the board, to not tear away, to resist abrasion, etc.

It is for these various reasons that the running edge of a snowboard, in addition to being made of steel, is arranged over the entire periphery of the board. This reinforcement, which is extended to the end portions, i.e., the tail and the shovel, also makes it possible to lighten the structure of these portions for an identical solidity, the running edge compensating for the decrease in their thickness.

Another reason for adopting peripheral running edges in snowboards is the search for a frontal gliding when an obstacle is encountered.

Thus, the manufacturers have peripherally protected the ski boards with a running edge made out of a shaped element which extends around the board, its free ends substantially joining one another, without any positive linkage however, such shaped element being solely maintained by attachment elements embedded in the board during molding of the latter.

Running edges of this type are also known, but which are made in two portions to facilitate the shaping, but whose jointed ends of each are not linked.

There results a number of disadvantages, because during a shock, the resistance of the junction zone is weak, and a separation of these ends of the running edges can occur, leading to a misalignment or to a lifting which can facilitate the tearing under certain circumstances.

SUMMARY OF THE INVENTION

Therefore, the object of the invention is to improve the board's resistance to shocks throughout the running edge.

Another object of the invention is the improvement to the rigidity of the turned-up ends which form the tail and the shovel, in order to further lighten them, for the purpose of optimizing the rigidity relative to the weight.

To this end, the invention relates to a gliding board, especially a snowboard with a composite structure, including a gliding bottom surface surrounded with a peripheral metallic running edge, wherein the metallic running edge is constituted by at least one steel shaped element whose length is substantially equal to the periphery of the bottom surface, and whose free ends are affixed to one another at a butt connecting point, via an effective mechanical linkage, so as to obtain a running edge that closes over itself.

The present invention is also related to the characteristics which will become apparent from the following description, and which must be considered separately or according to all of their possible technical combinations.

BRIEF DESCRIPTION OF THE DRAWINGS

This description, which is provided by way of a nonlimiting example, will help to better understand how the invention can be embodied with reference to the annexed drawings, in which:

FIGS. 5–7 are cross sectional views showing successive phases of assembling a core with respect to the bottom surface, to the running edge, and to the lower mechanical resistance element, on the one hand, and the upper mechanical resistance element, on the other hand; more particularly:

FIG. 5 shows a first sub-assembly, which includes a lower mechanical resistance element, a bottom layer, and a running edge, inserted into a lower mold cavity;

FIG. 6 shows the core being applied to the lower sub-assembly, with an upper sub-assembly being applied to the core, the upper sub-assembly including an upper mechanical resistance element and a decorative and protective layer; and FIG. 7 shows the upper mold part closed upon the lower mold part with the aforementioned snowboard components positioned therein.

DETAILED DESCRIPTION OF THE PREFERRED EMBODIMENTS

Figure 1:
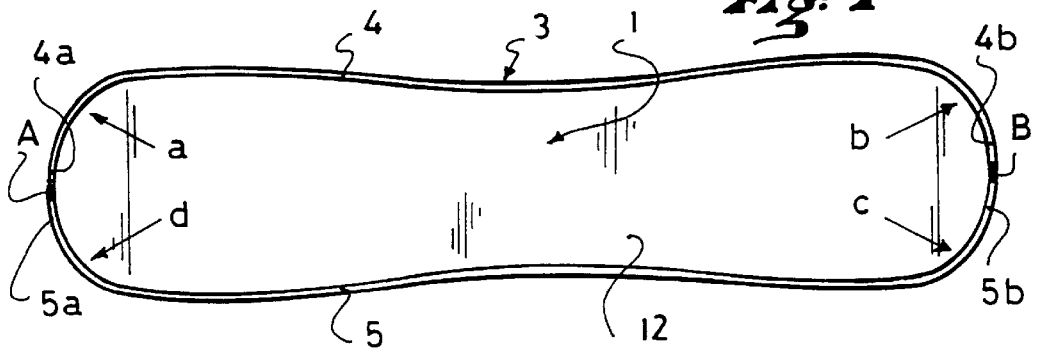
FIG. 1 is a bottom view of a snowboard showing a running edge according to the invention.
Figure 2:
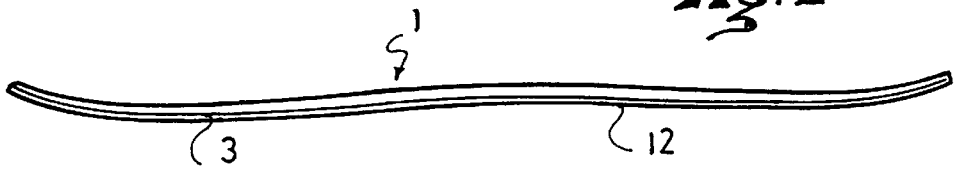
FIG. 2 is a side view of a snowboard according to FIG. 1.

FIGS. 1 and 2 show a ski board, or snowboard, which essentially has a board 1 including a bottom surface 12 about which the running edge 3 is fixed.

Generally, the ski board has a composite structure and is constituted by a solid core 9 about which at least one upper mechanical resistance element 10 is adhered, on the one hand, and at least one lower mechanical resistance element 11 on which a gliding bottom surface 12 of a bottom layer is surrounded with a peripheral metallic running edge 3, on the other hand.

According to the invention, the metallic running edge 3 is constituted, according to the present example of the invention, by two shaped elements 4 and 5 made of steel, whose total length is substantially equal to that of the periphery of the bottom surface 12 and whose free ends 4*a*, 4*b*, and 5*a*, 5*b*, respectively, are affixed to one another at a butt connecting point via an effective, or permanent, mechanical linkage A, B, so as to obtain a running edge 3 which closes over itself. In other words, the free ends 4*a*, 4*b* and 5*a*, 5*b* are affixed to one another at respective butt joints A, B to obtain a continuous, or endless, running edge 3.

Figure 3:
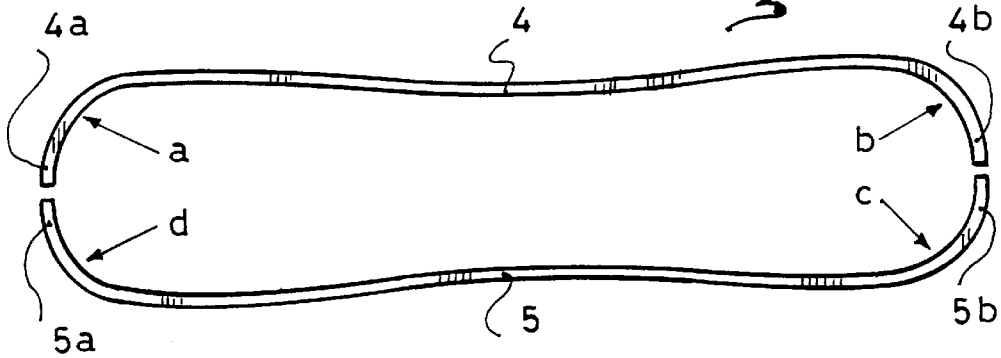
FIG. 3 is a view showing one of the phases of the running edge manufacturing process corresponding to the bending of the ends of the two shaped elements after the cut.

Preferably, and as shown in FIG. 1, the effective connecting points A, B, of the shaped elements 4, 5, forming the running edge 3 are located at the front and rear ends of the bottom surface 12 in the bent or curved zones a, b, c, d, of the shaped elements 4 and 5. As can be seen in FIGS. 1 and 3, the bent zones a, b, c, d, curve inwardly from the generally longitudinally extending zones of the shaped elements 4, 5.

Nevertheless, there is nothing to prevent the position of the connecting points A, B, from being different on the periphery of the running edge 3.

Preferably, the effective mechanical linkage of the ends 4*a*, 4*b*, and 5*a*, 5*b*, of the shaped elements 4 and 5 forming the running edge 3, is carried out by means of welds A, B.

Figure 4:
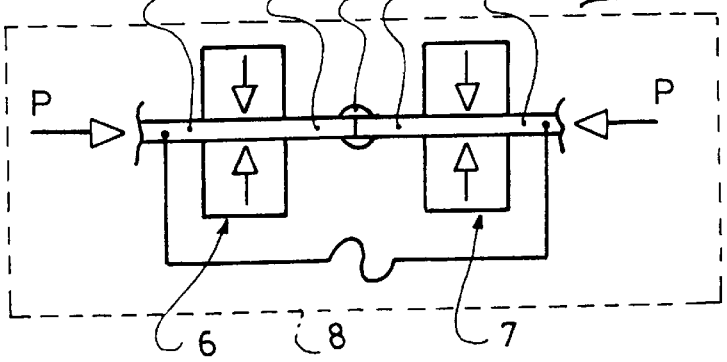
FIG. 4 is a view showing a phase subsequent to that of FIG. 3, which corresponds to the effective linkage of the ends of the shaped elements constituting the running edge.

According to another characteristic of the invention, the peripheral running edge 3 is obtained according to a process illustrated in FIGS. 3 and 4, and whose phases are as follows:

cutting and affixing the length of the two shaped elements 4 and 5, to correspond to the perimeter of the board to be obtained;

bending of the ends of the shaped elements 4 and 5, in the zones a, b, c, d, to adapt them to the front and rear contours of the board to be obtained;

end-to-end positioning and holding in place of the ends 4*a*, 4*b*, 5*a*, 5*b*, of the shaped elements 4 and 5, by means of jaws 6 and 7 of a flash welding machine 8;

passage of a strong electric current causing the melting and thereby the close linkage of such ends 4*a*, 4*b*, and 5*a*, 5*b*, which are butt positioned under pressure P, without addition of material;

annealing of the welded running edge 3, at a temperature that is less than that of the flash welding;

emery grinding of the welding zones A, B.

It must be noted here that the annealing phase is not performed on the entire running edge but only in enlarged zones of the welds A, B, in order to prevent the steel from being brittle in this zone, and to cause it to recover all of its original elasticity, To performed this type of flash welding, there is a particularly well adapted resistance butt welding head that is marketed by Technax Corporation.

The axial pressure P for holding the ends in place is on the order of about 2 bars. After melting, the penetration depth is about 1 to 2 mm.

Of course, one could also very well envision braze welding, ultrasonics, and laser induction linkages.

From a running edge 3 thus manufactured, the board itself is then obtained through a process illustrated in FIGS. 5, 6, and 7, which includes a first step of preparing the solid core 9 made of a synthetic foam, a second step of making the running edge 3 as described hereinabove, and a step of assembling such core 9 and the running edge 3 with the upper 10 and lower 11 mechanical resistance elements and with the bottom surface 12.

The aforementioned third step consists of performing the following successive operations:

a first lower sub-assembly is arranged in a first lower cavity 13 of a mold 14, which includes:

the gliding bottom surface 12;

the lower mechanical resistance element 11;

the peripheral running edge 3 previously welded and constituting a monoblock sub-assembly.

the lower surface of the solid core 9 is applied on this first sub-assembly via adhesive means 15;

an upper second sub-assembly is arranged on the core 9, which is adapted to cover the upper surface and the lateral surfaces of such core 9 via adhesive means 15*a*, 15*b*, during the subsequent molding operation, this sub-assembly including:

the upper mechanical resistance element 10;

a decorative and protective layer 16.

the mold 14 is closed by the second upper cavity 17 to carry out the molding;

removal from the mold;

final press shaping of the turned-up ends of the board.

The decorative and protective layer 16 provides the outermost upper surface and peripheral side surface of the board.

It is interesting to note here that since the final press shaping of the turned-up ends of the board occurs after the removal from the mold, the invention provides an additional advantage with respect to the prior art, in that in the past, during this shaping operation, the non-jointed ends of the running edge had a tendency to move apart during the lifting of the shovel and of the tail. This is no longer permitted due to the invention, because such ends are affixed to one another.

It is also interesting to note that it is not necessary to laterally bend the portions 4 and 5 of the running edge along the side cut, because the shaped element is sufficiently resilient to assume its shape in the mold. The grip of this running edge in the composite structure of the board is sufficiently substantial to maintain the shape of the side cut and to resist the elastic return force.

The assembly technique that has just been described is not limiting because other molding methods can be used.

Thus, the core 9, instead of being designed previously, could be made by injection in the mold between the upper mechanical resistance element 10 and the lower mechanical resistance element 11, which are previously arranged and configured in the mold 14.

One can also envision that during the closure of the mold 14 by the second upper cavity 17, the core 9 deforms the second upper sub-assembly 10, 16, within such cavity, as shown in the figures to have an upper part and two depending lateral portions.

The second sub-assembly 10, 16, can also be preformed in its final configuration in a previously separate operation.

According to the present example, the lower 15, lateral 15*a* and upper 15*b* adhesive means of the rigid core 9 are constituted by a solid adhesive film arranged about such core 9 during the first step of its preparation, and its has lateral extensions 18 which extend on both sides of the parting line of the mold 14, in order to also ensure the adhesion of the lateral edges of the lower 10 and upper 11 mechanical resistance elements to one another in this zone.

Reference is made to the commonly owned French Patent Application No. 92 09 735 which relates to the various methods for applying an adhesion film about a core, the disclosure of which is hereby incorporated by reference thereto in its entirety.

What is claimed:

1. A gliding board comprising:

a bottom surface adapted to glide upon a surface, the bottom surface having a periphery;

a running edge engaging and extending entirely around the periphery of the bottom surface, the running edge comprising at least one steel shaped element having free ends affixed together in the form of a permanent mechanical butt joint to obtain a continuous running edge extending around the periphery of the bottom surfaces;

the at least one shaped element including a longitudinally extending portion and a portion extending inwardly from the longitudinally extending portion at a front end and at a rear end, respectively, of the gliding board, said butt joint being formed in at least one of the inwardly projecting portions.

2. A gliding board according to claim 1, wherein:

the free ends of the at least one shaped element are affixed together in the form of a permanent mechanical butt joint by means of a weld.

3. A gliding board according to claim 1, further comprising:

at least one upper mechanical resistance element, separate from said running edge, said mechanical resistance element having lateral portions, said running edge being positioned below said lateral portions of said mechanical resistance element.

4. A gliding board according to claim 1, further comprising:

an upper sub-assembly;

a core; and a lower sub-assembly, said lower sub-assembly including a gliding layer, said bottom surface constituting a bottom surface of said gliding layer, said running edge constituting a component of said lower sub-assembly.

5. A gliding board according to claim 4, wherein:

said running edge includes a portion positioned beneath at least a portion of said core.

6. A gliding board according to claim 4, wherein:

said lower sub-assembly further comprises a lower reinforcement layer, said running edge includes a portion overlapping said lower reinforcement layer.

7. A gliding board comprising:

a bottom surface adapted to glide upon a surface the bottom surface having a periphery;

a running edge engaging and extending entirely around the periphery of the bottom surface, the running edge comprising two steel shaped elements having a pair of free ends, each of the free ends of one of the two elements being affixed to a respective one of the free ends of the second of the two elements in the form of a permanent mechanical butt joint to obtain a continuously extending running edge around the periphery of the bottom surface;

each of the pair of shaped elements including:

a longitudinally extending portion;

a front portion extending inwardly from the longitudinally extending portion; and a rear portion extending inwardly from the longitudinally extending portion;

wherein one of the butt joints is formed in the front portion of the shaped elements and one of the butt joints is formed in the rear portion of the shaped elements.

8. A gliding board according to claim 7, wherein:

each of the butt joints is formed by means of a weld.

9. A method of making a gliding board, said method comprising:

(A) preparing a solid core of synthetic foam;

(B) preparing a running edge from at least one steel shaped element having free ends affixed together in the form of a permanent mechanical butt joint to obtain a continuous running edge;

(C) assembling the core, the running edge and additional components of the gliding board in a mold, the mold having a lower cavity and an upper cavity, said assembling comprising:

(i) arranging a lower sub-assembly on the lower cavity of the mold, the lower sub-assembly comprising a lowermost gliding layer, a lower mechanical resistance element, and the continuous running edge;

(ii) arranging the solid core on the lower sub-assembly, the solid core being positioned over at least a portion of the running edge;

(iii) arranging an upper sub-assembly on the solid core with an adhesive between the upper sub-assembly and the solid core, the upper sub-assembly comprising an upper mechanical resistance element and a decorative protective layer;

(D) closing the upper cavity of the mold on the lower cavity of the mold to mold the lower sub-assembly, core, and upper sub-assembly to form a molded structure;

(E) removing the molded structure from the mold;

(F) shaping front and rear ends of the molded structure to form the snowboard.

10. A method according to claim 9, wherein said preparing a running edge comprises:

cutting at least one steel shaped element to have a length corresponding to a perimeter of the gliding board, said at least one shaped element having at least two free ends;

bending said at least one shaped element to assume a contour to adapt to a shape of a periphery of the gliding board;

positioning and holding said at least two free ends in end-to-end abutment to form at least one butt joint;

welding said free ends together at said butt joint at a determined temperature by passing an electric current through said free ends under axial end-to-end pressure to melt said free ends without adding material;

annealing said welded running edge at a temperature less than said determined temperature;

emery grinding said running edge at said at least one butt joint.

11. A method according to claim 9, wherein:

the closing of the upper cavity of the mold on the lower cavity of the mold to mold the lower sub-assembly, core, and upper sub-assembly to form a molded structure comprises deforming the upper sub-assembly by pressing the upper sub-assembly, as the upper cavity of the mold is closed, onto the solid core to assume a shape of the solid core.

12. A method according to claim 9, wherein:

before said arranging an upper sub-assembly on the solid core, the upper sub-assembly is preformed to a shape corresponding to a shape of the solid core.

13. A method according to claim 9, wherein:

the mold has a parting line between said upper cavity and said lower cavity;

said preparing a solid core of synthetic foam comprises applying a solid adhesive film on outer surfaces of the solid core, said adhesive film constituting the adhesive between the upper sub-assembly and the solid core, the solid adhesive film including lateral extensions extending from opposite lateral sides of the core along said parting line of the mold, said lateral extensions of said solid adhesive film ensuring adhesion of lateral edges of said lower mechanical resistance element and said upper mechanical resistance element.

* * * * *